United States Patent [19]

Norman et al.

[11] 3,941,589

[45] Mar. 2, 1976

[54] ABRASION-RESISTANT REFRIGERATION-HARDENABLE WHITE CAST IRON

[75] Inventors: Telfer E. Norman, Lakewood, Colo.; Douglas A. Stolk, Holland, Mich.

[73] Assignee: Amax Inc., New York, N.Y.

[22] Filed: Feb. 13, 1975

[21] Appl. No.: 549,553

[52] U.S. Cl. ..... 75/125; 75/123 CB; 75/126 A; 75/126 B; 75/126 C; 148/35

[51] Int. Cl.[2] ..... C22C 38/20; C22C 38/38

[58] Field of Search .. 75/125, 126 A, 126 B, 126 C, 75/123 CB; 148/35

[56] References Cited

UNITED STATES PATENTS

| | | | |
|---|---|---|---|
| 2,253,873 | 8/1941 | Trantin | 75/125 |
| 3,271,992 | 9/1966 | Stewart | 75/126 A |
| 3,623,922 | 11/1971 | Williams et al. | 75/125 |

FOREIGN PATENTS OR APPLICATIONS

| | | | |
|---|---|---|---|
| 260,896 | 5/1970 | U.S.S.R. | 75/125 |

*Primary Examiner*—C. Lovell
*Assistant Examiner*—Arthur J. Steiner
*Attorney, Agent, or Firm*—Harness, Dickey & Pierce

[57] ABSTRACT

A tough abrasion-resistant refrigeration-hardenable white cast iron containing as its essential alloying constituents about 2.5% to about 3.5% carbon, about 2.5% to about 3.5% manganese, about 12% to about 22% chromium, about 1% to about 2% silicon, about 1.5% to about 3.0% molybdenum, about 1% to about 2% copper, and the balance iron along with conventional residual elements and incidental impurities present in usual amounts.

7 Claims, No Drawings

ABRASION-RESISTANT REFRIGERATION-HARDENABLE WHITE CAST IRON

BACKGROUND OF THE INVENTION

A variety of so-called low-alloy and high-alloy cast iron compositions have heretofore been used or proposed for use in the fabrication of components subject to severe abrasion during service, such as for example, for use in the fabrication of pump components for handling sand and abrasive slurries, chute liners, sand and shot blast equipment and cast liners in ore grinding mills and the like. Typical of such alloys are those described in U.S. Pat. No. 2,662,011 and U.S. Pat. No. 3,410,682, comprising high chromium white cast irons containing nickel and molybdenum as essential alloying constituents. It is conventional practice when casting components from such white cast irons to subject them to further heat treatments to enhance their hardness and wear resistance over that provided in the as-cast condition. In many instances, castings composed of prior art type white cast iron alloys having relatively thick sections, or sections varying in thickness cannot be satisfactorily heat treated to achieve optimum properties due to the susceptibility of such castings to damage or fracture during the heat treatment cycle.

The present invention provides a high-alloy nickel-free high chromium white cast iron which is composed of a novel combination of alloying constituents present in carefully controlled amounts such that the iron is possessed of good toughness and abrasion resistance in the as-cast condition. The mechanical properties of cast components can be further enhanced, even for castings having configurations which cannot ordinarily be heat treated in accordance with prior art practices, by subjecting them to a refrigeration hardening treatment, whereby further beneficial transformations in the microstructure of the alloy are effected.

SUMMARY OF THE INVENTION

The benefits and advantages of the present invention are achieved by a high-alloy white cast iron possessed of excellent toughness and wear-resistance in both the as-cast and refrigerationhardened condition and which contains, as its essential alloying constituents, from about 2.5% to about 3.5% carbon, about 12% to about 22% chromium, about 1.5% to about 3.0% molybdenum, about 2.5% to about 3.5% manganese, about 1% to about 2% copper, about 1% to about 2% silicon, and the balance iron along with normal residual elements and incidental impurities present in the usual amounts. In accordance with a preferred embodiment of the present invention, the alloy contains from about 3% to about 3.3% carbon, about 17% to about 20% chromium, about 1.9% to about 2.2% molybdenum, about 2.8% to about 3.2% manganese, about 1.1% to about 1.4% copper, about 1.4% to about 1.7% silicon, and the balance essentially iron.

The combination of the essential alloying constituents in the specific proportions specified minimizes the proportion of bainite and pearlite in the predominantly austenitic as-cast matrix microstructure, which upon refrigeration at temperatures usually below about −100°F (−75°C) for a period of several hours effects a transformation of some of the austenite to martensite. This transformation contributes to the excellent wear and abrasion-resistance of the resultant castings which, in combination with their toughness, high strength and corrosion resistance, renders them eminently suitable for a wide range of uses.

Additional benefits and advantages of the present invention will become apparent upon a reading of the description of the preferred embodiments taken in conjunction with the specific examples provided.

DESCRIPTION OF THE PREFERRED EMBODIMENTS

The composition of the white cast iron alloy comprising the present invention including the acceptable and preferred compositions thereof are herein described and are set forth in the subjoined claims in terms of percentages by weight, unless clearly indicated to the contrary.

The ranges of the acceptable as well as preferred proportions of the individual alloying constituents comprising the white cast iron composition of the present invention are set forth in Table 1.

TABLE 1

| Ingredient | White Cast Iron Alloy Composition Useable Range, % | Preferred Range, % |
|---|---|---|
| Carbon | 2.5 – 3.5 | 3.0 – 3.3 |
| Chromium | 12.0 – 22.0 | 17.0 – 20.0 |
| Molybdenum | 1.5 – 3.0 | 1.9 – 2.2 |
| Manganese | 2.5 – 3.5 | 2.8 – 3.2 |
| Copper | 1.0 – 2.0 | 1.1 – 1.4 |
| Silicon | 1.0 – 2.0 | 1.4 – 1.7 |
| Iron | Balance | Balance |

The principal alloying constituent of the white cast iron is chromium, which may range from as little as 12% to as high as 22%, and is preferably controlled between about 17% to about 20%. The chromium content contributes strength and toughness to the iron alloy and prevents the formation of a continuous network of brittle carbides, the presence of which in the microstructure would detrimentally reduce the toughness and impact resistance of the casting. Quantities of chromium less than about 12% are undesirable due to formation of such continuous and brittle carbides, particularly when carbon is employed in the upper end of the permissible range, and also resulta in inadequate abrasion resistance and a decrease in toughness. On the other hand, quantities of chromium in excess of about 22% are undesirable because the amount of carbon which can be added, to maximize abrasion resistance, is limited due to poor toughness in high chromium alloys containing high carbon.

The amount of carbon is controlled within about 2.5% to about 3.5%, and preferably within a range of about 3.0% to about 3.3%. Quantities of carbon below about 2.5% are generally undesirable because inadequate hardness and abrasion resistance is exhibited by the resultant casting. At carbon concentrations above about 3.5%, undesirable coarse carbide needles, which reduce toughness, are present in the microstructure. In view of the foregoing, it is preferred to control the carbon content between a range preferably of about 3.0% to about 3.3%.

The molybdenum alloying constituent contributes strength and abrasion resistance to the resultant casting, as well as preventing formation of pearlite during cooling of the casting to room temperature. Quantities of molybdenum less than about 1.5% are insufficient to prevent the formation of pearlite in the matrix during cooling of complex commercial castings to room temperature, while quantities in excess of 3.0% are undesirable because, in the presence of high manganese contents, the austenite matrix formed in the casting is too stable to transform during subsequent refrigeration treatment. Particularly satisfactory results are obtained when the concentration of molybdenum is controlled within a range of about 1.9% to about 2.2%.

The manganese alloying constituent also prevents formation of pearlite during the cooling of a casting to room temperature maintaining an austentic microstructure which subsequently can be transformed during the refrigeration hardening step. Manganese contents below about 2.5% are undesirable because pearlite can form too readily in complex commercial castings, while quantities in excess of about 3.5% are unsatisfactory because the austenite in the casting is made too stable and it will not transform to martensite in the refrigeration treatment.

The copper alloying constituent provides important transformation characteristics to the austenitic matrix when used in conjunction with manganese, silicon and molybdenum. The combination of these four elements in appropriate amounts render the austenite sufficiently stable to prevent the formation of pearlite on cooling complex commercial castings to room temperature, but permit the transformation of some of the austenite to harder and more abrasion resistant martensite during subsequent refrigeration treatment. Quantities of copper less than about 1% are ineffective in influencing the above transformation characteristics while, on the other hand, amounts greater than 2% are unsatisfactory due to increased stabilization of the austenite so that it will not transform readily to martensite during refrigeration.

The silicon constituent is an agent which tends to promote the formation of pearlite during cooling of the casting to room temperature. The silicon is added to raise the $M_s$, martensite start temperature, enabling subsequent transformation of the predominantly austenitic microstructure to martensite, thereby achieving optimum hardness and wear resistance. Quantities of silicon in excess of about 2% are undesirable since quantities of this magnitude contribute toward the formation of pearlite in the microstructure of the casting while concentratons usually less than about 1% are unsatisfactory because the $M_s$ temperature of the casting will be too low for achieving the desired transformation of austenite to martensite during the refrigeration hardening treatment.

The remainder of the alloy consists essentially of iron along with incidental impurities and normal residual elements present in usual amounts. Included among conventional impurities are phosphorus and sulfur, which can be tolerated in amounts up to about 0.10% and 0.06%, respectively, without adverse effects on the properties of the cast iron.

Generally, cast components composed of the high-alloy white cast iron of the present invention can be satisfactorily employed in an "as-cast" condition due to the excellent hardness and wear resistance of the alloy and the tendency to undergo a mechanical transformation in service from an austenitic to a martensitic microstructure. It is usual practice, particularly in the case of cast components of relatively thick cross section, to subject them to stress relieving by heating them to a moderate temperature generally ranging from about 350°F (175°C) to about 500°F (260°C) for a period of about 1 hour plus about one hour per inch of casting thickness, followed by an air cooling step. Particularly satisfactory results are obtained when stress-relieving components in the temperature range of about 400°F (205°C) to about 450°F (230°C).

The refrigeration hardening treatment of castings constitutes a preferred practice in which the component in an as-cast condition is refrigerated by any one of a variety of techniques to a temperature generally below about −75°F (−60°C) for a period of time generally ranging from about 1 to about 6 hours, which will vary in consideration of the particular temperature employed, and the section size of the casting. Particularly satisfactory results are obtained by packing the casting in dry ice or immersing the cast component in a vessel filled with an organic solvent such as methanol in which blocks of dry ice are packed so as to effect a refrigeration of the casting to temperatures generally of about −100°F (−75°C). Refrigeration chambers are available which utilize liquid nitrogen as the cooling medium, and these may be used to achieve the desired transformation to martensite. Such transformation is a function of temperature, but it takes appreciable time to equalize the temperature in a complex commercial casting. Periods of about 2 hours, depending upon the specific mass of the casting, have been found satisfactory in most instances. It is also conventional, after the refrigeration hardening treatment, to subject the casting to a stress relief treatment in the same manner as hereinbefore described in connection with cast components in an as-cast condition.

It is further contemplated that cast components in an ascast condition can be austenitized by effecting a reheating thereof to a temperature ranging from about 1700°F to about 1900°F (925° to 1040°C) and held at that temperature for a period of from about 2 to about 6 hours at temperature. Particularly satisfactory conditions include a heating to a temperature ranging from about 1725°F (940°C) to about 1775°F (970°C) and a retention of the casting at that temperature for a period of from about 3 to 5 hours. At the conclusion of the dwell period, the casting is cooled to room temperature in still air, whereafter it is stress-relieved in the same manner as previously described. The foregoing treatment results in a casting in a so-called "austenitized and air-cooled condition".

In order to further illustrate the high-alloy white cast iron composition of the present invention, the following example is provided. It will be understood that the example is provided for illustrative purposes and is not intended to be limiting of the scope of the invention as herein described and as set forth in the subjoined claims.

EXAMPLE

Two 125-pound heats, hereinafter designated as Heat A and Heat B, respectively, were prepared by induction melting in air. The heats had a nominal composition of 17.5% chromium, 3% manganese, 2% molybdenum, 1.6% silicon, 1.5% copper, with the balance iron. The charge materials consisted of Armco iron, graphite, ferrochromium, ferrosilicon, ferrosulfur and ferrophosphorus. The two heats were superheated to 2700°F (1480°C), whereupon the ferromolybdenum, ferromanganese and copper were added. The heat subsequently was poured at 2500°F (1370°C) into baked sand molds for producing test specimens, molds for producing samples for chemical analyses, and Tectip-type molds to define solidification temperature.

The chemical analyses of the compositions of Heats A and B are set forth in the following table.

| Ingredient | Composition (Percent) Heat A | Heat B |
|---|---|---|
| Carbon | 3.25 | 3.26 |
| Chromium | 17.20 | 17.39 |
| Molybdenum | 2.07 | 2.09 |
| Manganese | 2.95 | 2.95 |
| Copper | 1.29 | 1.55 |
| Silicon | 1.63 | 1.61 |
| Sulfur | 0.025 | 0.024 |
| Phosphorus | 0.035 | 0.036 |
| Iron | Balance | Balance |

Heat A was cast into a 4-inch by 6-inch by 8-inch (100 by 150 by 200 mm) block employing a baked sand mold which was fed from the bottom. Heat B, on the other hand, was cast into three baked sand molds providing castings measuring 1-inch by 6-inches by 8-inches (25 by 150 by 200 mm) to make jaw crusher plate specimens. In each case, the castings were cooled to room temperature while in the mold.

An analysis of the liquidus and solidus temperatures of Heat A revealed these values to be 2215°F and 2200°F (1215°C and 1205°C), respectively. The 4-inch by 6-inch by 8-inch (100 by 150 by 200 mm) block from Heat A was trepanned with an electrical discharge machine to provide three cylindrical test specimens which were 1⅛ inches in diameter by 6-inches long and were cut from the central region of the block.

Pairs of specimens comprising a trepanned cylindrical test specimen from Heat A and a jaw crusher plate test specimen from Heat B were subjected to the following treatments:

a. stress relieved at 425°F (220°C) for two hours simulating a so-called "as-cast" condition;
b. refrigerated to −100°F (−75°C) for 2 hours, and thereafter stress-relieved at 420°F (220°C) for 2 hours simulating a "refrigeration hardened" condition; and
c. heated to 1750°F (955°C), held at temperature for 4 hours, cooled to room temperature in still air, and stress-relieved at 425°F (220°C) for 2 hours, simulating an "austenitized and air cooled" condition.

The jaw crusher plate test specimens were ground to a size of 7½ by 5⅜ inches by ⅞-inch, to which two steel retaining ribs were subsequently welded and the specimens were placed in a jaw crusher according to established laboratory procedures, as more fully described in a publication entitled "Gouging Abrasion Test for Materials Used in Ore and Rock Crushing: Part I - Description of the Test," by F. Borik and D. L. Sponseller, *Journal of Materials*, JMLSA (ASTM) Volume 6, No. 3, September 1971, pp. 576–589. Each plate specimen was weighed prior to installation and placed in the crusher opposite to a weighed, movable T-1 type A steel reference plate. One ton of morainal rock was crushed during the course of the test, whereafter the plates were cleaned and re-weighed to determine the amount of metal lost. Gouging abrasion wear ratios were calculated for each crusher plate test specimen by dividing its weight loss by the weight loss of the reference T-1 type A steel crusher plate, and the results thereof, together with hardness values, are set forth in the following table.

Gouging Abrasion Test Results

| Specimen Heat Treatment | Wear Ratio | Hardness Values of Jaw Crusher Plate Specimens: Unabraded HB 3000* | HRC | Abraded HRC |
|---|---|---|---|---|
| a) As-Cast | 0.150 | 495 | 51.6 | 56.0 |
| b) Refrigeration Hardened | 0.132 | 573 | 55.2 | 59.0 |
| c) Austenitized and Air-Cooled | 0.124 | 601 | 58.1 | 60.1 |

*Brinell Hardness Number (3000 kg. tungsten carbide ball)

It is apparent from the values as set forth in the foregoing table that the resistance to gouging abrasion of the white cast iron is improved over the as-cast condition by both the refrigeration hardening treatment and the austenitizing and air-cooling treatment. The low wear ratio values show that the cast iron composition of the present invention loses only a small fraction of the weight loss by the T-1 type A steel reference plate in the same crushing operation. As will be further noted, the hardness values of the jaw crusher specimens also increase in accordance with the foregoing treatments and experience a further increase in hardness as a result of the work hardening that occurred during the rock crushing test procedure.

Portions of the worn jaw crusher test specimens were sectioned, and additional specimens were prepared from the cylindrical test specimens trepanned from the block of Heat A for evaluation of their rubber wheel abrasion resistance. This latter property was evaluated employing a test designated as "Rubber Wheel Abrasion Test" (RWAT), employing a standard laboratory procedure as more fully described in *Society of Automotive Engineers*, Publication No. 700687. Briefly, the test comprises pressing a test specimen which has been previously weighed against a 7-inch diameter rubber coated wheel with a force of 50 pounds. The wheel rotates in a silica sand slurry at a speed of 240 rpm and the slurry consists of 940 grams of water and 1500 grams of sand (AFS testing sand 50–70). The abrasive sand slurry is discarded after each 5,000 revolution test run and is replaced with a fresh slurry. Conventionally, three tests are performed on each specimen employing wheels of a different rubber durometer hardness. At the completion of each test run, the specimen is cleaned and re-weighed to determined the weight of metal lost during the test.

The value of the weight lost when employing a wheel coated with a 55 Durometer hardness rubber, interpolated from the test results, in addition to the hardness values, are set forth in the following table:

Rubber Wheel Abrasion Test Results and Hardness Values

| Specimen Heat Treatment | RWAT Weight Loss at 55 Durometer, g | Hardness Values HB 3000 | Rc |
|---|---|---|---|
| Heat A: Heavy Section Casting | | | |
| a) As-Cast | 0.116 | 522 | 53.8 |
| b) Refrigeration Hardened | 0.078 | 648 | 58.5 |
| Heat B: Light Section Casting | | | |
| a) As-Cast | 0.048 | 495 | 51.6 |
| b) Refrigeration Hardened | 0.050 | 573 | 55.2 |
| c) Austenitized and Air-Cooled | 0.045 | 601 | 58.1 |

A comparison of the RWAT values obtained as set forth in the foregoing table with values obtained on other prior art type abrasion-resistant white cast iron reveals the alloy of the present invention to possess excellent resistance to abrasion under such lowstress high-wear conditions as typified by the test procedure. It is also evident from the foregoing results that cast section size has an important influence on the abrasion resistance, due primarily to the effect of section size on distribution of carbide phase. It should be noted that the refrigeration treatment improved the abrasion resistance of the heavy cast sections, whereas there was essentially no change in the excellent abrasion resistance of the light cast sections.

While it will be apparent that the invention herein disclosed is well calculated to achieve the benefits and advantages set forth herein, it will be appreciated that the invention is susceptible to modification, variation and change without departing from the spirit thereof.

What is claimed is:

1. An abrasion-resistant refrigeration hardenable white cast iron consisting essentially of about 2.5% to about 3.5% carbon, about 12% to about 22% chromium, about 1.5% to about 3.0% molybdenum, about 2.5% to about 3.5% manganese, about 1.0% to about 2.0% copper, about 1% to about 2% silicon, and the balance iron together with incidental impurities and normal residual elements present in the usual amounts.

2. The abrasion-resistant refrigeration hardenable white cast iron as defined in claim 1, wherein carbon is present in an amount of about 3.0% to about 3.3%, chromium is present in an amount of about 17% to about 20%, molybdenum is present in an amount of from about 1.9% to about 2.2%, manganese is present in an amount of about 2.8% to about 3.2%, copper is present in an amount of about 1.1% to about 1.4%, silicon is present in an amount of about 1.4% to about 1.7%.

3. The abrasion-resistant refrigeration hardenable white cast iron as defined in claim 1, further characterized by a matrix microstructure free from pearlite and comprising a mixture of martensite and austenite in amounts depending on section size and treatment following casting.

4. An abrasion-resistant article in a refrigeration hardened state consisting essentially of about 2.5% to about 3.5% carbon, about 12% to about 22% chromium, about 1.5% to about 3.0% molybdenum, about 2.5% to about 3.5% manganese, about 1.0% to about 2.0% copper, about 1% to about 2% silicon, and the balance iron together with incidental impurities and normal residual elements present in the usual amounts.

5. The abrasion-resistant article in a refrigeration hardened state as defined in claim 4, wherein carbon is present in an amount of about 3.0% to about 3.3%, chromium is present in an amount of about 17% to about 20%, molybdenum is present in an amount of from about 1.9% to about 2.2%, manganese is present in an amount of about 2.8% to about 3.2%, copper is present in an amount of about 1.1% to about 1.4%, silicon is present in an amount of about 1.4% to about 1.7%.

6. The article as defined in claim 4, in the form of a component of a pump device.

7. The article as defined in claim 4, having a Brinell hardness greater than about 550.

* * * * *